US007938392B2

(12) United States Patent
Saito et al.

(10) Patent No.: US 7,938,392 B2
(45) Date of Patent: May 10, 2011

(54) MEDIUM FEED CONTROL IN AN IMAGE FORMING APPARATUS

(75) Inventors: Yuka Saito, Kanagawa (JP); Yutaka Matsumoto, Saitama (JP); Nobuhiro Shindo, Tokyo (JP); Daisuke Masui, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 158 days.

(21) Appl. No.: 12/353,392

(22) Filed: Jan. 14, 2009

(65) Prior Publication Data

US 2009/0189330 A1 Jul. 30, 2009

(30) Foreign Application Priority Data

Jan. 29, 2008 (JP) ..... 2008-017961
Dec. 2, 2008 (JP) ..... 2008-307737

(51) Int. Cl.
*B65H 3/44* (2006.01)
*B65H 5/26* (2006.01)

(52) U.S. Cl. ..... 271/9.06; 271/9.09; 271/9.03; 271/9.05; 399/391; 399/392

(58) Field of Classification Search ..... 271/9.06, 271/9.09, 9.03, 9.05; 399/389, 391, 392
See application file for complete search history.

(56) References Cited

U.S. PATENT DOCUMENTS 4,265,440 A * 5/1981 Shibazaki et al. ..... 271/9.06
4,804,997 A * 2/1989 Mizude et al. ..... 399/389
5,130,757 A * 7/1992 Ito ..... 399/14
5,172,178 A * 12/1992 Oushiden et al. ..... 399/86
5,420,669 A * 5/1995 Imada ..... 399/16
5,709,377 A * 1/1998 Yoshioka et al. ..... 271/9.02
6,010,261 A * 1/2000 Maekawa ..... 400/605
6,125,242 A * 9/2000 Yamada ..... 399/23
6,206,360 B1 * 3/2001 Urata et al. ..... 271/9.06
6,259,468 B1 * 7/2001 Higuchi ..... 347/262
6,283,653 B1 * 9/2001 Higuchi ..... 400/582
6,606,466 B2 * 8/2003 Sato ..... 399/82
6,810,219 B2 * 10/2004 Yokobori et al. ..... 399/45
6,817,794 B2 * 11/2004 Kakutani ..... 400/582
7,433,645 B2 * 10/2008 Aiyama ..... 399/391
7,643,768 B2 * 1/2010 Katahira ..... 399/75

FOREIGN PATENT DOCUMENTS

JP H09-104547 4/1997
JP 2006-224379 8/2006

* cited by examiner

*Primary Examiner* — Stefanos Karmis
*Assistant Examiner* — Luis A Gonzalez
(74) *Attorney, Agent, or Firm* — IPUSA, PLLC

(57) ABSTRACT

A method of controlling medium feeding in an image forming apparatus includes an image forming step of forming an image on a medium in response to an image forming request, and a feed control step of selecting one of a plurality of first medium feed units that feeds a medium corresponding to attribute information that matches medium attribute information included in the image forming request, and of selecting a second medium feed unit upon finding matching between attribute information indicative of a medium fed by the second medium feed unit and the medium attribute information included in the image forming request if none of the first medium feed units feeds a medium corresponding to the attribute information that matches the medium attribute information included in the image forming request.

6 Claims, 17 Drawing Sheets

FIG.4

| DATA TYPE | SETTING |
|---|---|
| DOCUMENT NAME | aaa |
| DATE | 2007/6/27 |
| TIME | 20:34:00 |
| PAPER FEED TRAY | AUTO |
| LANGUAGE CODE | shift_jis |
| PAPER SIZE | A3 LONGITUDINAL |
| PAPER TYPE | PLAIN SHEET |
| PUNCH SETTING | ON |
| STAPLE SETTING | OFF |
| RING-BINDER SETTING | OFF |
| BINDING SETTING | OFF |
| DOCUMENT TEXT DATA | aaaaaaaaaaaaaa<br>bbbbbbbbbbbbbb<br>cccccccccccc |

a

FIG.5

| PAPER FEED TRAY | PAPER SIZE | PAPER TYPE | AUTOMATIC TRAY SELECTION |
|---|---|---|---|
| TRAY1 | A4 LONGITUDINAL | PLAIN | 1 |
| TRAY2 | A5 LONGITUDINAL | PLAIN | 1 |
| TRAY3 | A6 LONGITUDINAL | RECYCLED | 1 |
| TRAY4 | A4 TRAVERSE | COLOR | 1 |
| TRAY5 | B5 LONGITUDINAL | PLAIN | 1 |
| TRAY6 | B5 LONGITUDINAL | PLAIN | 1 |
| TRAY7 | B5 TRAVERSE | RECYCLED | 1 |
| MANUAL FEED TRAY | UNKNOWN | UNKNOWN | 0 |

FIG.9

| SIZE | SHORT SIDE | LONG SIDE |
|---|---|---|
| A2 | 420 | 594 |
| A3 | 297 | 420 |
| A4 | 210 | 297 |
| A5 | 148 | 210 |
| A6 | 105 | 148 |
| B3 | 353 | 500 |
| B4 | 250 | 353 |
| B5 | 176 | 250 |
| B6 | 125 | 176 |
| B7 | 88 | 125 |

FIG.10

| PAPER FEED TRAY | PAPER SIZE | WIDTH (mm) | PAPER TYPE | AUTOMATIC TRAY SELECTION |
|---|---|---|---|---|
| TRAY1 | A4 | – | PLAIN | 1 |
| TRAY2 | A4 | – | PLAIN | 1 |
| TRAY3 | A4 | – | RECYCLED | 1 |
| TRAY4 | A4 | – | COLOR | 1 |
| TRAY5 | B5 | – | PLAIN | 1 |
| TRAY6 | B5 | – | PLAIN | 1 |
| TRAY7 | B5 | – | RECYCLED | 1 |
| MANUAL FEED TRAY | UNKNOWN | 297 | UNKNOWN | 0 ~ b |

FIG.13

| PAPER FEED TRAY | PAPER SIZE | PAPER TYPE | AUTOMATIC TRAY SELECTION |
|---|---|---|---|
| TRAY1 | A4 LONGITUDINAL | PLAIN | 1 |
| TRAY2 | A5 LONGITUDINAL | PLAIN | 1 |
| TRAY3 | A6 LONGITUDINAL | RECYCLED | 1 |
| TRAY4 | A4 TRAVERSE | COLOR | 1 |
| TRAY5 | B5 LONGITUDINAL | PLAIN | 1 |
| TRAY6 | B5 LONGITUDINAL | PLAIN | 1 |
| TRAY7 | B5 TRAVERSE | RECYCLED | 1 |
| MANUAL FEED TRAY | A6 LONGITUDINAL | PLAIN | 0 ~ c |

MEDIUM FEED CONTROL IN AN IMAGE FORMING APPARATUS

BACKGROUND OF THE INVENTION

1. Field of the Invention

The disclosures herein generally relate to an image forming apparatus, a medium feed control method, and a computer program.

2. Description of the Related Art

There is an automatic tray selection technology for feeding a print medium in an image forming apparatus. A plurality of trays are provided to store different media having different attributes such as different sizes and types, and these medium attributes are managed on a tray-specific basis. With automatic tray selection, one of the trays that stores a desired medium is selected to feed the medium at the time of printing to form an image.

It is often the case that an image forming apparatus is provided with a manual feed tray in addition to the trays subjected to automatic tray selection. In general, the trays subjected to automatic tray selection are used to store media that would be frequently used. A manual feed tray, on the other hand, is used to feed a medium of size and type that is not frequently used. Because of this, it is often the case that no medium attribute is managed for the media stored in a manual feed tray, or that only part of the attributes are managed for the media stored in a manual feed tray. Such a manual feed tray is not subjected to automatic tray selection.

Japanese Patent Application Publication No. 2006-224379 discloses a print system technology that has a function to switchover a feed inlet to include a manual feed tray as one of the trays subjected to automatic tray selection. In this technology, a preset setting is made to determine whether to feed a paper sheet from a manual feed tray if a tray storing a required medium among the trays subjected to automatic tray selection is empty.

The technology disclosed in the above-noted patent document, however, always selects a manual feed tray to feed a paper sheet if the tray storing a required medium is empty, regardless of what type of medium is stored in the manual feed tray. Error will thus occur if the size of the fed paper sheet is different from the required size.

A manual feed tray is often used for the purpose of feeding a special-type sheet such as an OHP (overhead projector) sheet or a heavy paper sheet. If such a special-type sheet is subjected to duplex printing or various finishing, troubles such as a paper jam or a mechanical failure of the finishing module may occur.

There is thus a need for an image forming apparatus, a medium feed control method, and a computer program that can perform automatic tray selection based on the attributes of a medium stored in a manual feed tray when the manual feed tray is used as one of the trays subjected to automatic tray selection.

SUMMARY OF THE INVENTION

It is a general object of at least one embodiment of the present invention to provide an image forming apparatus and a feed control method that may substantially eliminate one or more problems caused by the limitations and disadvantages of the related art.

According to one aspect, an image forming apparatus includes: an image forming unit configured to form an image on a medium in response to an image forming request; a plurality of first medium feed units configured to feed a medium corresponding to the image forming request to the image forming unit; a second medium feed unit configured to feed a medium to the image forming unit; an attribute management unit configured to manage first attribute information indicative of media fed by the first medium feed units and second attribute information indicative of a medium fed by the second medium feed unit, the second attribute information being smaller in amount than the first attribute information; and a feed control unit configured to select one of the first medium feed units that feeds a medium corresponding to the first attribute information that matches medium attribute information included in the image forming request, and to select the second medium feed unit upon finding matching between the second attribute information indicative of a medium fed by the second medium feed unit and the medium attribute information included in the image forming request if none of the first medium feed units feeds a medium corresponding to the first attribute information that matches the medium attribute information included in the image forming request.

According to another aspect, a method of controlling medium feeding in an image forming apparatus includes an image forming step of forming an image on a medium in response to an image forming request, and a feed control step of selecting one of a plurality of first medium feed units that feeds a medium corresponding to attribute information that matches medium attribute information included in the image forming request, and of selecting a second medium feed unit upon finding matching between attribute information indicative of a medium fed by the second medium feed unit and the medium attribute information included in the image forming request if none of the first medium feed units feeds a medium corresponding to the attribute information that matches the medium attribute information included in the image forming request.

According to yet another aspect, a machine-readable recording medium having a program embodied therein to cause a computer to perform the method of controlling medium feeding as described above is provided.

According to at least one embodiment of the image forming apparatus, the medium feed control method, and the computer program, it is possible to perform automatic tray selection based on the attributes of a medium stored in a manual feed tray when the manual feed tray is used as one of the trays subjected to automatic tray selection.

BRIEF DESCRIPTION OF THE DRAWINGS

Other objects and further features of embodiments will be apparent from the following detailed description when read in conjunction with the accompanying drawings, in which:

FIG. 4 is a drawing showing an example of data items included in print data;

FIG. 5 is a drawing showing an example of a table in which paper feed trays and attributes are associated with each other;

FIG. 9 is a drawing showing a table in which data indicative of lengths of a long side and a short side of a paper sheet are associated with paper sheet attribute information;

FIG. 10 is a drawing showing how the width of a paper sheet to be fed from a manual feed tray is managed;

FIG. 13 is a drawing showing how the attribute of a paper sheet to be fed from a manual feed tray is managed;

DESCRIPTION OF THE PREFERRED EMBODIMENTS

In the following, embodiments of the present invention will be described with reference to the accompanying drawings.

Figure 1:
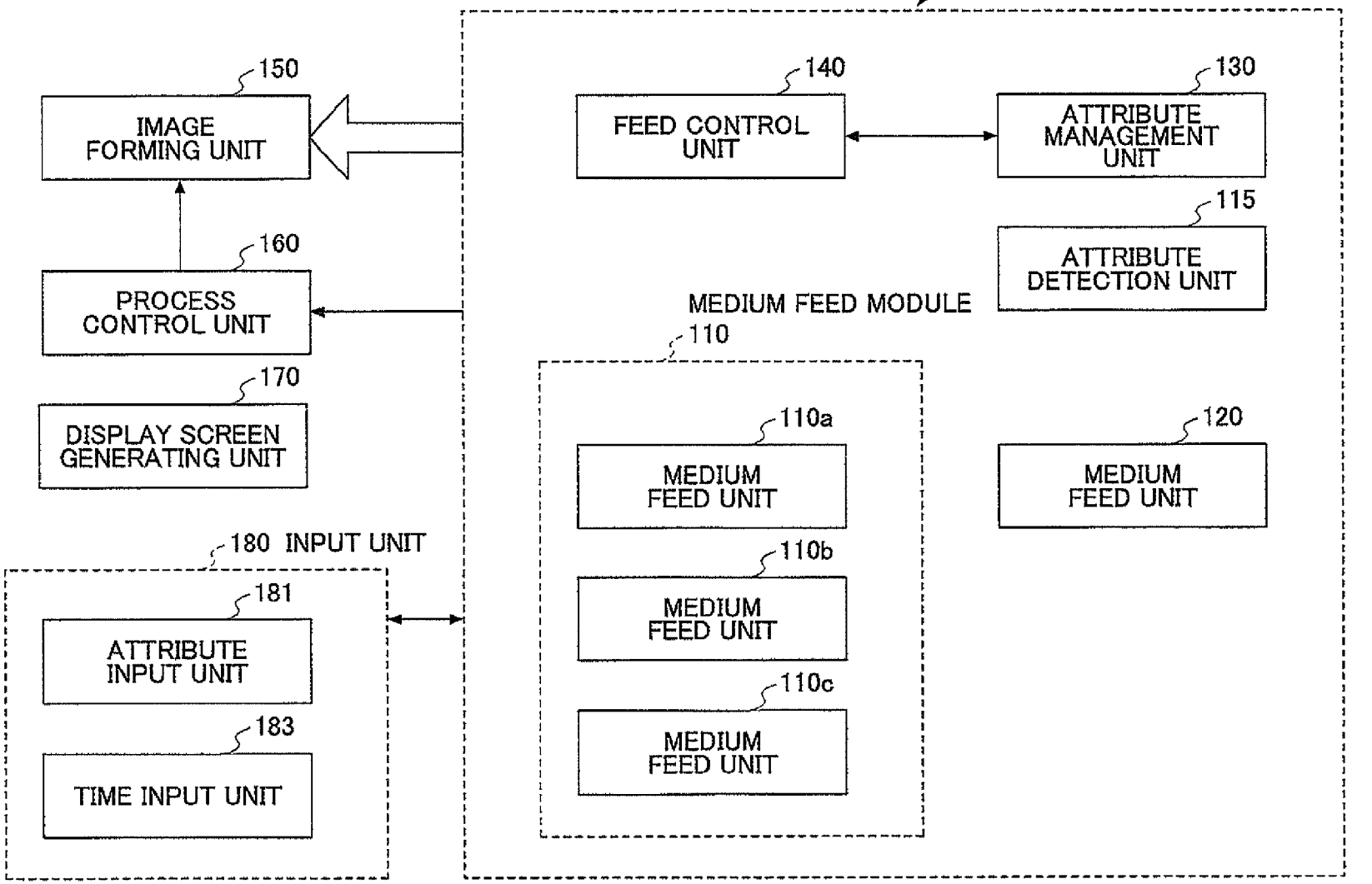
FIG. 1 is a drawing showing an example of the functional configuration of an image forming apparatus according to an embodiment of the present invention.

FIG. 1 is a drawing showing an example of the functional configuration of an image forming apparatus according to an embodiment of the present invention. An image forming apparatus 1 of FIG. 1 includes a medium feed module 110, a medium feed unit 120, an attribute management unit 130, a feed control unit 140, an attribute detection unit 115, an image forming unit 150, a process control unit 160, a display screen generating unit 170, and an input unit 180.

The medium feed module 110 and the medium feed unit 120 feed media that are used by the image forming unit 150 to form images. The medium feed module 110 includes paper sheet cassettes, for example, to store paper media having attributes such as types and sizes that are of frequent use. The medium feed module 110 supplies a medium of a required attribute in response to a request to form an image. The medium feed module 110 may include a medium feed unit 110*a*, a medium feed unit 110*b*, and a medium feed unit 110*c*. The attributes of the media stored in the paper sheet cassettes are managed by the attribute management unit 130 on a medium-feed-unit-specific basis. The medium feed module 110 may be configured to include one or more medium feed units.

The medium feed unit 120 may include a manual feed tray, for example, and is used to feed a medium having an attribute that is of less frequent use. For example, the medium feed unit 120 may be used to supply an OHP sheet, a heavy paper sheet, or the like. The medium feed unit 120 includes a guide unit that is used to insert a paper sheet. The attribute detection unit 115 can utilize this guide to detect the width of the medium.

The attribute detection unit 115 detects the attributes of a media fed from the medium feed module 110. For example, the attribute detection unit 115 detects the size of a medium stored in a paper sheet cassette, i.e., detects the length and width of the stored medium. The attribute detection unit 115 may further detect the width of a media fed from the medium feed unit 120.

The attribute management unit 130 controls and manages the medium attributes detected by the attribute detection unit 115 and the medium attributes input through the input unit 180. The attribute management unit 130 controls and manages the medium attributes of media fed from the medium feed units of the medium feed module 110 separately for each medium feed unit. The attribute detection unit 130 further controls and manages the medium attributes of a medium fed from the medium feed unit 120. The amount of information specifying the attributes of a medium fed from the medium feed unit 120 is equal to or smaller than the amount of information specifying the attributes of a medium fed from the medium feed module 110.

The feed control unit 140 selects a medium feed unit for supplying a medium having requested attributes based on the medium attribute information included in a request to form an image that is input into the image forming apparatus 1. With this arrangement, the feed control unit 140 attains the supplying of a medium that matches an image forming request. The attribute management unit 140 selects a medium feed unit based on the medium attributes corresponding to the medium feed units of the medium feed module 110.

The feed control unit 140 may select the medium feed unit 120 to feed a medium if the medium feed module 110 does not feed a medium that matches an image forming request. The case in which the medium feed module 110 does not feed such a medium may occur when the medium attributes included in the image forming request do not correspond to any of those of the medium feed units provided in the medium feed module 110. That is, such a case may occur when the medium attributes managed by the attribute management unit 130 do not match the medium attributes included in the image forming request.

The case in which the medium feed module 110 does not feed such a medium may also occur when the medium attributes identified by the medium attribute information included in the image forming request correspond to those of one of the medium feed units provided in the medium feed module 110, but the paper sheet cassette of such medium feed unit is empty.

When the attributes of a medium fed from the medium feed unit 120 are managed by the attribute management unit 130, the feed control unit 140 causes the medium feed unit 120 to feed a medium upon matching between such managed attribute information and the medium attribute information included in the image forming request. The managed attribute information may indicate a medium width, and the medium attribute information included in the image forming request may specify the size of a medium. In such a case, the feed control unit 140 may cause the medium feed unit 120 to feed a medium if one of the long side and the short side specified by the size information matches the width of the medium. The feed control unit 140 may cause the medium feed unit 120 to feed a medium if the value of the long side specified by the medium size information included in the image forming request matches the value of the medium width managed by the attribute management unit 130.

In response to the image forming request, the image forming unit 150 forms an image on the medium that is fed from the medium feed module 110 or the medium feed unit 120. The image forming unit 150 may further perform a finishing process on the medium on which the image has been formed.

The finishing process performed with respect to a medium includes stapling, making punch holes, attaching a predetermined mark indicative of confidential nature, attaching an emboss image, etc.

The process control unit 160 controls whether a process such as a finishing process or duplex printing needs to be performed by the image forming unit 150. The process control unit 160 causes the image forming unit 150 to perform a finishing process if the image forming request indicates the need to perform the finishing process. The process control unit 160 causes the image forming unit 150 to print images on both sides of a medium if the image forming request indicates the need to perform duplex printing.

The process control unit 160 controls the image forming unit 150 to refrain from performing a finishing process and duplex printing despite the indication of the need to perform such a finishing process or duplex printing in the image forming request if a medium is fed from the medium feed unit 120. This arrangement can prevent a paper jam and other failures that would occur when a finishing process or duplex printing is performed with respect to a special-type sheet such as an OHP sheet or heavy paper sheet.

The display screen generating unit 170 generates a display screen that is to be displayed on the display unit of the image forming apparatus 1 or on the screen of a PC (not shown) to which the image forming apparatus 1 is connected to receive an image forming request. The display screen generating unit 170 generates a display screen to inform a user that the feed control unit 140 has selected the medium feed unit 120, upon occurrence of such selection.

The input unit 180 is used to enter instructions and conditions used for forming an image into the image forming apparatus 1. The input unit 180 may include an attribute input unit 181 and a time input unit 183. The attribute input unit 181 is used to enter the medium attribute information regarding a medium fed from the medium feed module 110 and/or the medium feed unit 120. The attribute input unit 181 may be implemented as a dial or the like provided on a paper sheet cassette of the medium feed module 110, or may be implemented as a display screen that prompts a user to enter instruction on an operation panel of the image forming apparatus 1.

The time input unit 183 is used to enter data indicative of a predetermined time length. The predetermined time length is a time length from the time at which it is determined that the medium feed module 110 is not going to feed a medium corresponding to the image forming request to the time at which the medium feed unit 120 is selected. The medium feed unit 120 is selected only upon the passage of this predetermined time length, so that the user may have time to load media into the medium feed module 110.

<Example of Hardware Configuration of Controller of Image Forming Apparatus>

Figure 2:
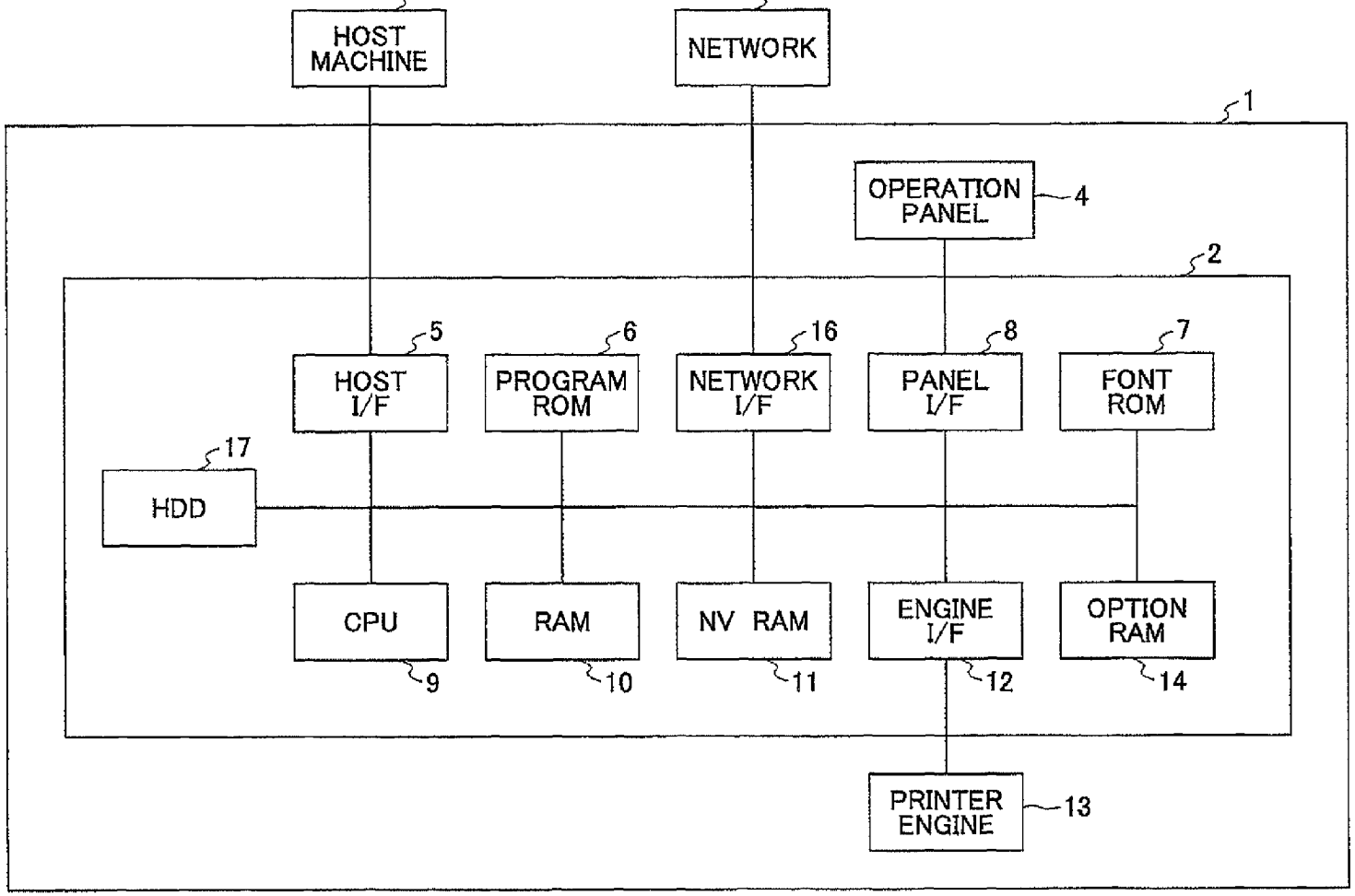
FIG. 2 is a drawing showing a hardware configuration of the controller of the image forming apparatus according to the present embodiment.

FIG. 2 is a drawing showing a hardware configuration of the controller of the image forming apparatus according to the present embodiment.

The image forming apparatus 1 may include a controller 2, an operation panel 4, and a printer engine 13. The controller 2 is directly connected to a host computer 3, and may also be connected to other computers through a network 15.

The controller 2 converts print data into image data for provision to the printer engine 13 in accordance with control code settings and control codes sent from the host computer 3 or another computer connected through the network 15.

The controller 2 may include a host interface 5, a program ROM 6, a font ROM 7, a panel interface 8, a CPU 9, a RAM 10, a NVRAM 11, an engine interface 12, an option RAM 14, a network interface 16, and an HDD 17.

The host interface 5 serves as an interface for control signals and image data supplied from the host computer 3 to the image forming apparatus 1 and an interface for signals indicative of apparatus states sent from the image forming apparatus 1 to the host computer 3.

The program ROM 6 is a memory unit that stores computer programs to be executed by the CPU 9. The font ROM 7 is a memory unit that stores various types of fonts for use in printing. The panel interface 8 serves as an interface between the controller 2 and the operation panel 4.

The CPU 9 executes computer programs stored in the program ROM 6 to process print data and control data supplied from the host computer 3. The RAM 10 serves as a work memory for use by the CPU 9. The RAM 10 may store print data supplied from the host computer 3 in units of pages, and may serve as a bitmap memory that stores image data into which the print data is converted. The NVRAM 11 is a non-volatile RAM, which is used to store data that needs to be retained after the main power of the image forming apparatus 1 is turned off.

The engine interface 12 serves as an interface for control signals and image data output from the controller 2 to the printer engine 13 and an interface for signals indicative of printer engine states sent from the printer engine 13 to the controller 2. The optional RAM 14 is a RAM provided as a backup.

The network interface 16 serves as an interface for control signals and print data supplied from a computer connected through the network 15 to the image forming apparatus 1 and an interface for signals indicative of apparatus states sent from the image forming apparatus 1 to the computer connected through the network 15.

The HDD 17 is a data storage device for storing a large volume of data. The HDD 17 may store document data such as print data supplied from the host computer 3. Such an arrangement can attain an accumulated document printing function that serves to print an image on a later occasion.

The operation panel 4 includes a display unit for displaying the status of the image forming apparatus 1 and an input unit that is used to enter instruction into the image forming apparatus 1. The printer engine 13 generates an image on a medium in response to image data and control signals supplied from the controller 2. More specifically, the printer engine 13 develops an electrostatic latent image formed on a photoconductive body, and transfers and fuses the developed image onto a paper sheet fed from a paper feed unit.

<Trays of Present Embodiment>

FIGS. 3 through 16 are drawings regarding the processes of automatic tray selection. In the embodiments that follow, the term "automatic tray selection" may also be used to refer to a process of selecting a medium corresponding to an image forming request by selecting a medium feed unit. Further, the "paper feed tray" used in the following description corresponds to the medium feed units 110*a* through 110*c* and the medium feed unit 120 shown in FIG. 1, and the "manual feed tray" corresponds to the medium feed unit 120. Further, an image forming request may be referred to as "print data".

<Process Performed When Automatic Tray Selection Includes Manual Feed Tray>

Figure 3:
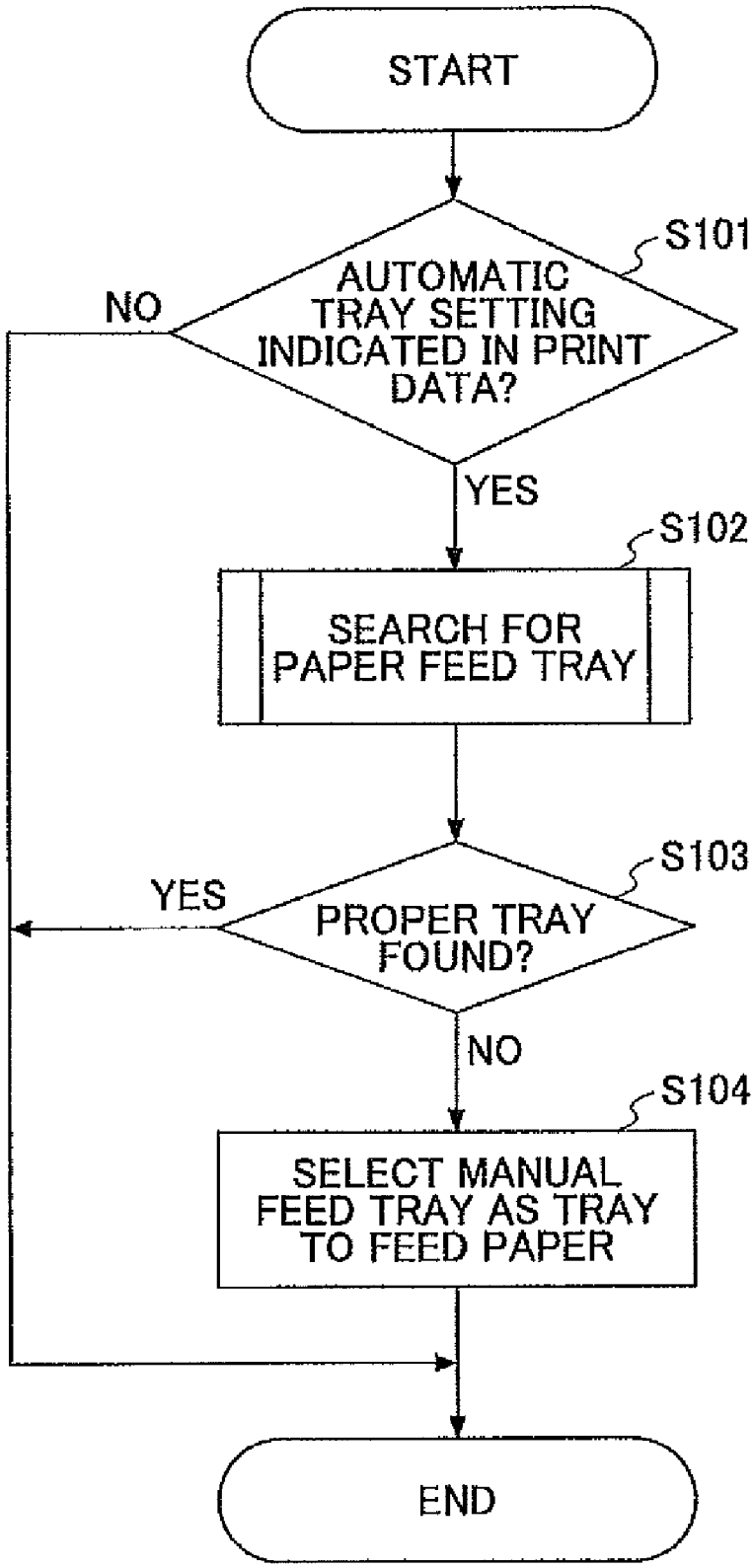
FIG. 3 is a drawing showing a process performed when automatic tray selection includes a manual feed tray.

FIG. 3 is a drawing showing a process performed when automatic tray selection includes the manual feed tray. In step s101 of FIG. 3, the feed control unit 140 checks whether a tray indication included in the print data is "automatic tray selection". In the case of automatic tray selection, the procedure proceeds to step S102. In the case of no automatic tray selection, the automatic tray selection process comes to an end.

The procedure proceeds from step S101 to step S102. In step S102, the feed control unit 140 searches for a paper feed tray whose paper sheet attributes managed by the attribute management unit 130 match required attributes. The procedure then proceeds from step S102 to step S103. If it is ascertained in step S103 that the matching tray is found, a determination is made to use this tray to feed a paper sheet. With this, the procedure comes to an end.

If step S102 fails to find a matching tray, the procedure proceeds to step S104. In step S104 following step S103, the feed control unit 140 determines that the manual feed tray is to be used to feed a paper sheet.

<Example of Print Data>

FIG. 4 is a drawing showing an example of data items included in print data. In the print data shown in FIG. 4, the item designated by reference symbol "a" indicates that a tray to feed a paper sheet is to be selected by automatic tray selection.

<Examples of Paper Feed Tray and Paper Sheet>

FIG. 5 is a drawing showing an example of a table in which paper feed trays and attributes are associated with each other. In FIG. 5, paper feed trays TRAY1 to TRAY7 are paper feed trays having paper sheet cassettes that store and supply paper sheets that are frequently used. These paper feed trays TRAY1 through TRAY7 are associated with respective attributes of paper sheets, i.e., information indicative of a sheet size and a paper type.

On the other hand, the attribute information for the manual feed tray indicates "Unknown" because the paper sheet to be fed is not yet determined. In FIG. 5, trays subjected to automatic tray selection during a routine print process are trays TRAY1 through TRAY7 to which respective paper sheet attributes are assigned. The manual feed tray is subjected to automatic tray selection, but is selected when the paper sheet attributes of the trays TRAY1 through TRAY7 do not match the print data. In the following embodiments, a description will be given of a case in which a paper sheet is fed from the manual feed tray.

<Process of Searching for Paper Feed Tray>

Figure 6:
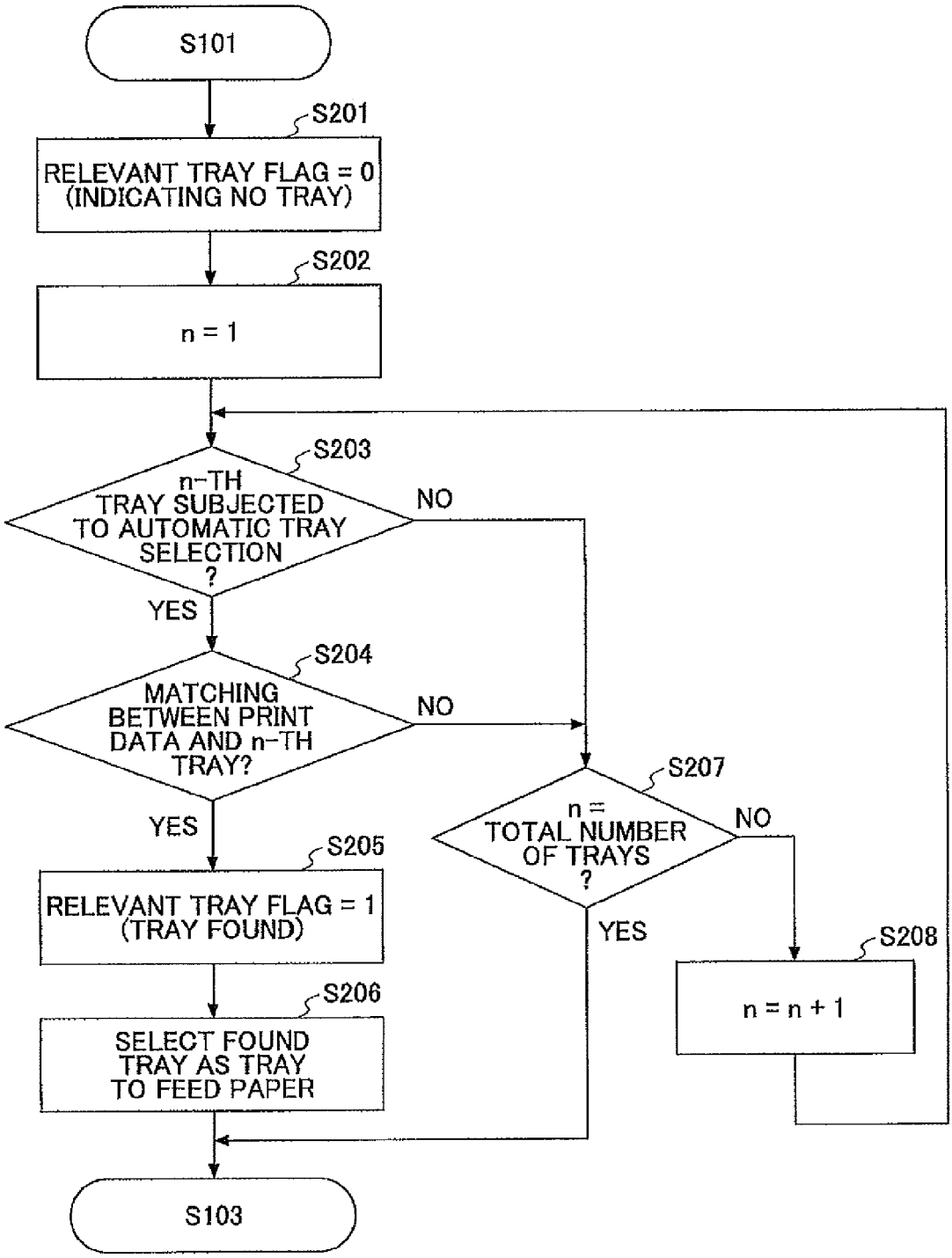
FIG. 6 is a flowchart showing a process of searching for a paper feed tray.

FIG. 6 is a drawing showing a process of searching for a paper feed tray as performed in step S102 of FIG. 3. The process shown in FIG. 6 may be performed by the feed control unit 140, for example. In step S201 of FIG. 6, a variable that indicates the presence or absence of a relevant paper feed tray is initialized to store a value indicative of the absence of a relevant paper feed tray. In this example, the value "0" may be assigned. In step S202 following step S201, a count n for identifying a paper feed tray is initialized to store the value "1".

The procedure proceeds from step S202 to step S203. In step S203, a check is made as to whether the n-th paper feed tray among the paper feed trays whose paper sheet attributes are managed by the attribute management unit 130 is subjected to the automatic tray search. If the n-th paper feed tray is subjected to the automatic tray search, the procedure proceeds to step S204. If the n-th paper feed tray is not subjected to the automatic tray search, the procedure proceeds to step S207.

In step S204 following step S203, a check is made as to whether the paper sheet attributes included in the print data match the attributes of a paper sheet fed by the n-th paper feed tray. If they match, the procedure goes to step S205. Otherwise, the procedure goes to step S207.

In step S205 following step S204, a variable that indicates the presence or absence of a relevant paper feed tray is made to store a value indicative of the presence of a relevant paper feed tray. In this example, the value "1" may be assigned. In step S206 following step S205, the n-th paper feed tray is determined to be the tray that is to feed a paper sheet. After the process of step S206, the procedure proceeds to step S103.

In step S207 following step S203 or step S204, a check is made as to whether the count n is equal to the number of the paper feed trays subjected to automatic tray selection. If the count n is equal to the total number of the paper feed trays, the procedure proceeds to step S103. If the count n is not equal to the total number of the paper feed trays, the procedure proceeds to step S208.

In step S208 following step S207, the count n for identifying a paper feed tray is incremented by 1. After step S208, the procedure returns to step S203 to repeat the procedure.

<Process Using Attribute of Paper Sheet to be Fed from Manual Feed Tray>

Figure 7:
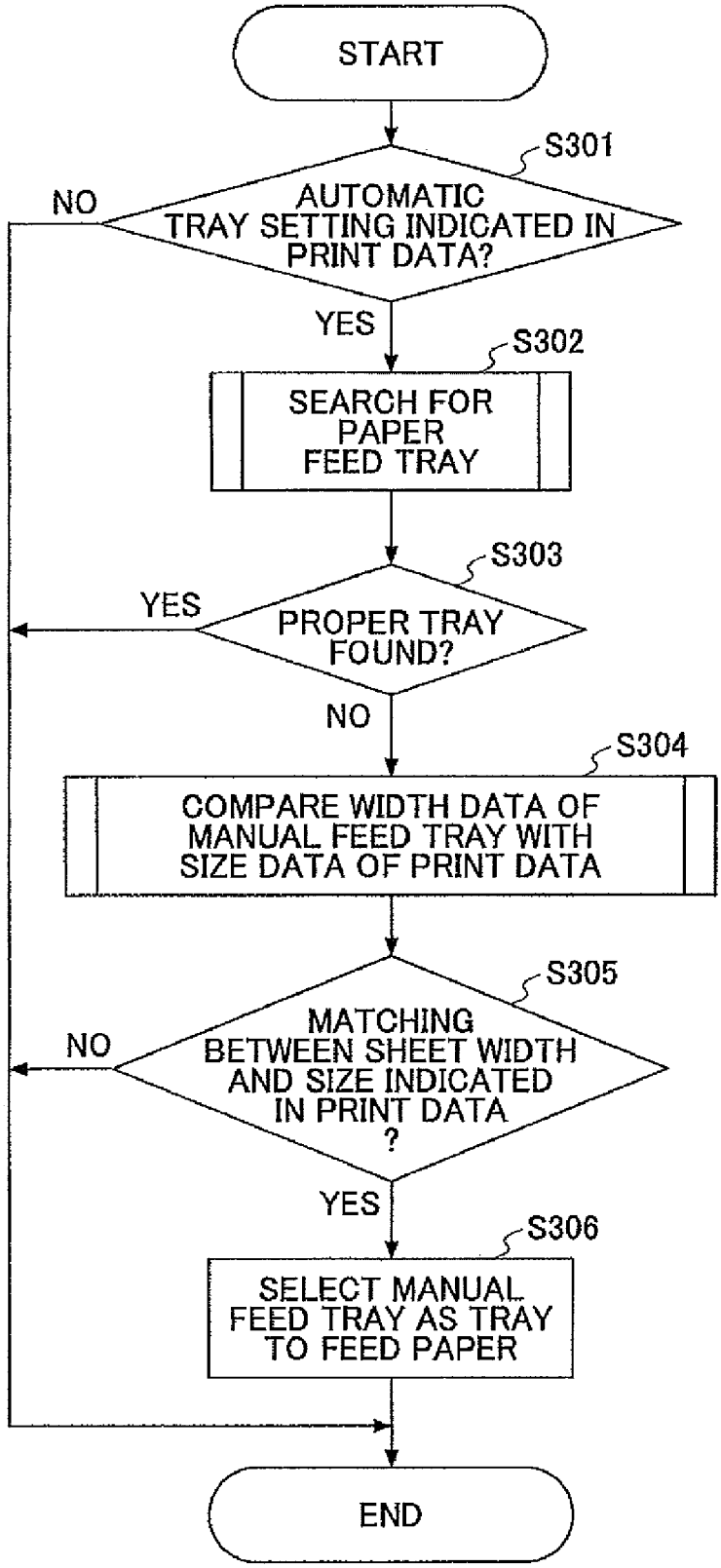
FIG. 7 is a flowchart showing an example of a process that uses information about the width of a paper sheet to be fed from a manual feed tray.

FIG. 7 is a drawing showing a process performed when none of the paper feed trays subjected to automatic tray selection supplies a paper sheet matching the attributes included in the print data, as in the case of FIG. 3. In this example, information about the width of a paper sheet to be fed from the manual feed tray is used. The process shown in FIG. 7 may be performed by the feed control unit 140, for example.

Steps S301 to S303 shown in FIG. 7 are the same as steps S101 through S103 shown in FIG. 3, and a description thereof will be omitted. In step S304 following step S303, the width of a paper sheet to be fed from the manual feed tray as managed by the attribute management unit 130 is compared with the information about the paper sheet size contained in the print data.

In step S305 following step S304, a check is made as to whether information about the width of a paper sheet to be fed from the manual feed tray matches the information about the paper sheet size contained in the print data. If matching is found, the procedure goes to step S306. If no matching is found, the procedure comes to an end with a recognition that there is no paper feed tray that feeds a paper sheet as required by the print data. In this case, the operation panel 4 of the image forming apparatus may present a display screen indicative of no matching for the paper sheet size required by the print data, for example.

<Detail of Process Using Width of Paper Sheet to be Fed from Manual Feed Tray>

Figure 8:
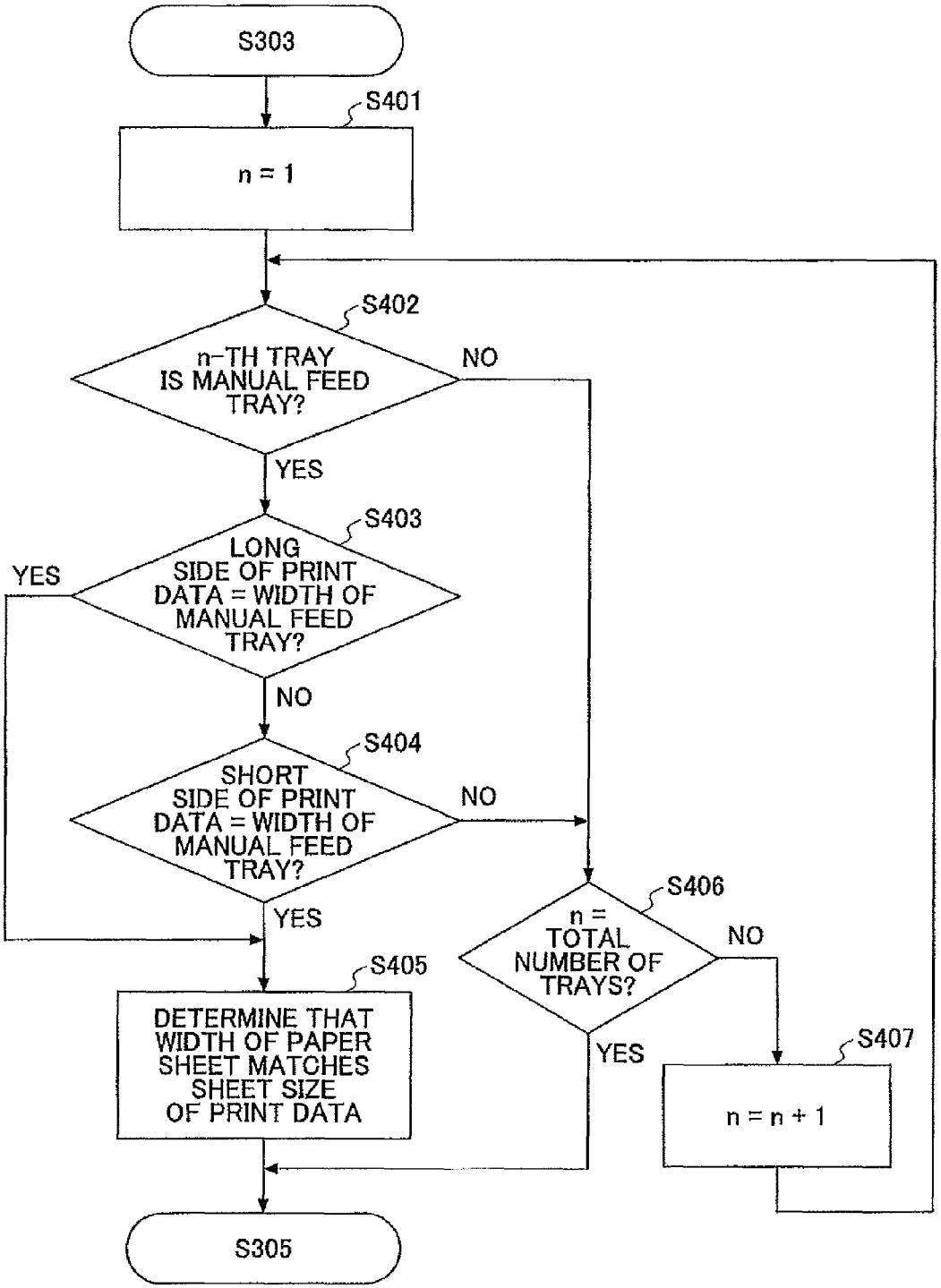
FIG. 8 is a drawing illustrating an example of a process that makes determination based on the presence or absence of matching between the attribute of a paper sheet to be fed from a manual feed tray and information indicative of paper sheet attributes contained in print data.

FIG. 8 is a drawing showing the detail of the process performed in step S304 of FIG. 7, illustrating an example of a process that makes a determination based on the presence or absence of matching between the attribute of a paper sheet to be fed from the manual feed tray and the information indicative of paper sheet attributes contained in the print data.

In step S401 of FIG. 8, a count for identifying a paper feed tray is initialized. In this example, the value "1" may be assigned.

In step S402 following step S401, a check is made as to whether the n-th tray is a manual feed tray. If the n-th tray is a manual feed tray, the procedure goes to step S403. Otherwise, the procedure goes to step S406.

In step S403 following step S402, a check is made based on the paper sheet attribute information contained in the print data as to whether the length of the long side of the paper sheet matches the width of a paper sheet to be fed from the manual feed tray. If they match, the procedure goes to step S405. Otherwise, the procedure goes to step S404.

In step S404 following step S403, a check is made based on the paper sheet attribute information contained in the print data as to whether the length of the short side of the paper sheet matches the width of a paper sheet to be fed from the manual feed tray. If they match, the procedure goes to step S405. Otherwise, the procedure goes to step S406.

In step S405, it is determined that the information about the width of a paper sheet to be fed from the manual feed tray matches the information about the paper sheet size contained in the print data. The procedure may come to an end without performing the process of step S405 (i.e., in the case of the flow that involves step S406). In such a case, it is determined that the information about the width of a paper sheet to be fed from the manual feed tray does not match the information about the paper sheet size contained in the print data.

FIG. 9 is a drawing showing a table that is used to acquire the length of a long side or short side of a paper sheet based on the paper sheet attribute information contained in the print data. In FIG. 9, length data for a short side and a long side are given with respect to each paper sheet size. Such a table may be stored in a memory unit (not shown) provided in the image forming apparatus 1. Alternatively, this table may be included in a computer program that is executed by the image forming apparatus 1 to provide the relevant functions.

The width of a paper sheet supplied from a manual feed tray may be acquired through the guide that is provided in the manual feed tray. The attribute management unit 130 manages data indicative of the acquired width by associating the data with the manual feed tray. FIG. 10 is a drawing showing how the width of a paper sheet to be fed from a manual feed tray is managed. In the table shown in FIG. 10, attributes of paper sheets to be fed from the paper feed trays TRAY1 through TRAY7 and the manual feed tray are associated with the respective trays.

In FIG. 10, the item designated by reference symbol "b" shows attribute information about a paper sheet to be fed from the manual feed tray. In FIG. 10, the width of a paper sheet to be fed from the manual feed tray is specified as "297 mm", and, also, the size and type of the paper sheet are indicated as "unknown".

As previously described, the width of a paper sheet to be fed from a manual feed tray may be acquired by the guide (i.e., the attribute detection unit 115) provided on the manual feed tray. With such a configuration, only the width of a medium can be detected. The indication that the sheet width is 297 mm means that the paper sheet to be fed from the manual feed tray is either A3 size (having a matching short side) or A4 size (having a matching long side) as shown in the table of FIG. 9 if the paper sheet is a standard size sheet. Namely, if a paper sheet is placed in a longitudinal direction (i.e., with its long side parallel to the travel direction), the width of the paper sheet acquired by the guide should indicate the length of the short side of this paper sheet. In such a case, the placed paper sheet should be A3 size if it is a standard size sheet. If a paper sheet is placed in a traverse direction (i.e., with its long side perpendicular to the travel direction), the width of the paper sheet acquired by the guide should indicate the length of the long side of this paper sheet. In such a case, the placed paper sheet should be A4 size if it is a standard size sheet. When step S306 of FIG. 7 specifies the manual feed tray as a tray to feed a paper sheet, the print data (i.e., the print condition specified in the print data) may indicate A3 size. In such a case, it may be possible that an A4-size sheet is fed if the sheet is placed in the traverse direction on the manual feed tray.

<Another Process Using Attribute of Paper Sheet to be Fed from Manual Feed Tray>

Figure 11:
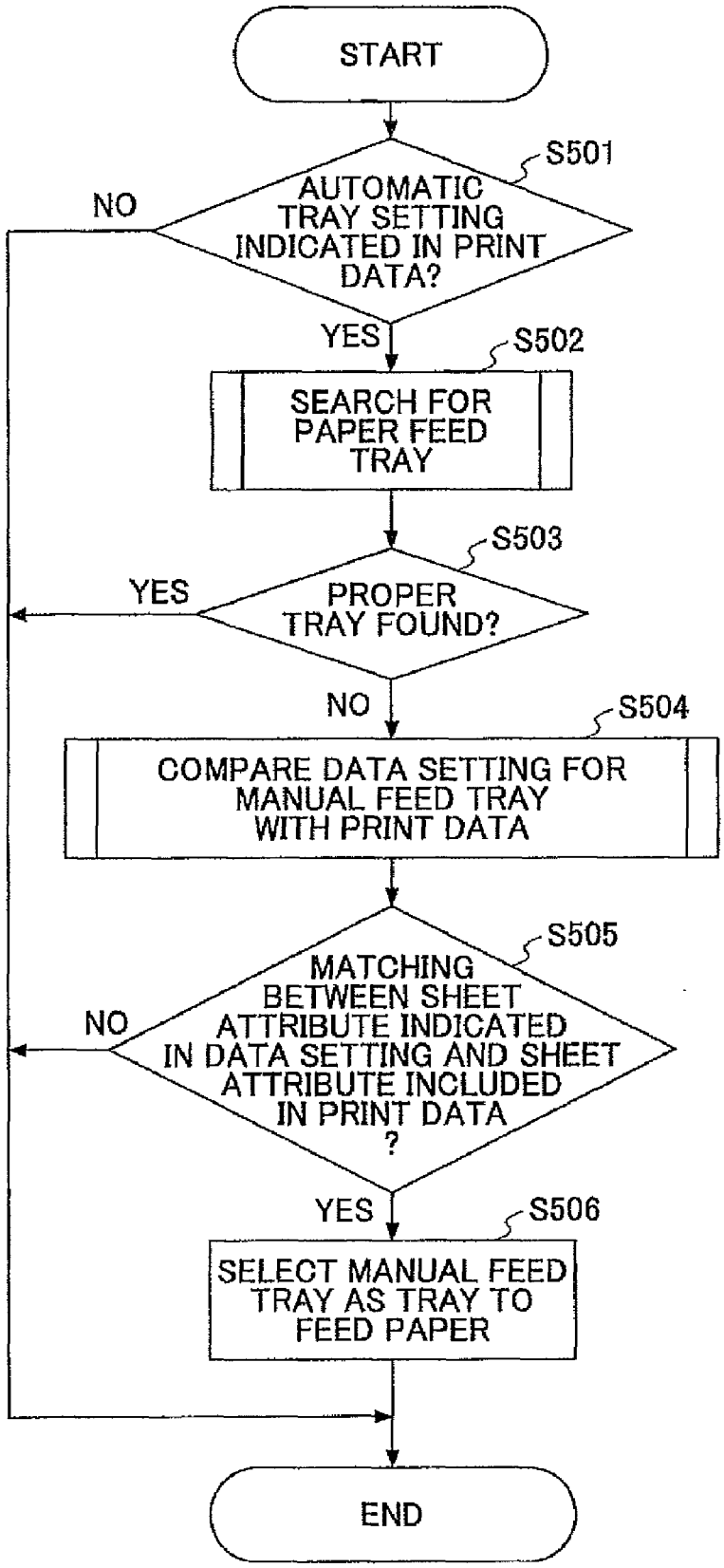
FIG. 11 is a flowchart showing a process that uses entered attribute information.

FIG. 11 is a drawing showing an example of a process that uses an attribute of a paper sheet to be fed from a manual feed tray as in the case of FIG. 7. In this example, attribute information input through the attribute input unit 181 is used.

Steps S501 through S506 shown in FIG. 11 are substantially the same as steps S301 through S306 shown in FIG. 7. Differences reside in step S504 and step S505, and a description thereof will be given in the following.

In step S504, the paper sheet attribute information specified for the manual feed tray and managed by the attribute management unit 130 is compared with the paper sheet attribute information contained in the print data. In step S505 following step S504, a check is made based on the results of the comparison performed in step S504 as to whether the paper sheet attribute information managed by the attribute management unit 130 matches, without inconsistency, the paper sheet attribute information contained in the print data. If they match, the procedure goes to step S506. Otherwise, the procedure comes to an end.

<Details of Process Using Information Specified for Paper Sheet to be Fed from Manual Feed Tray>

Figure 12:
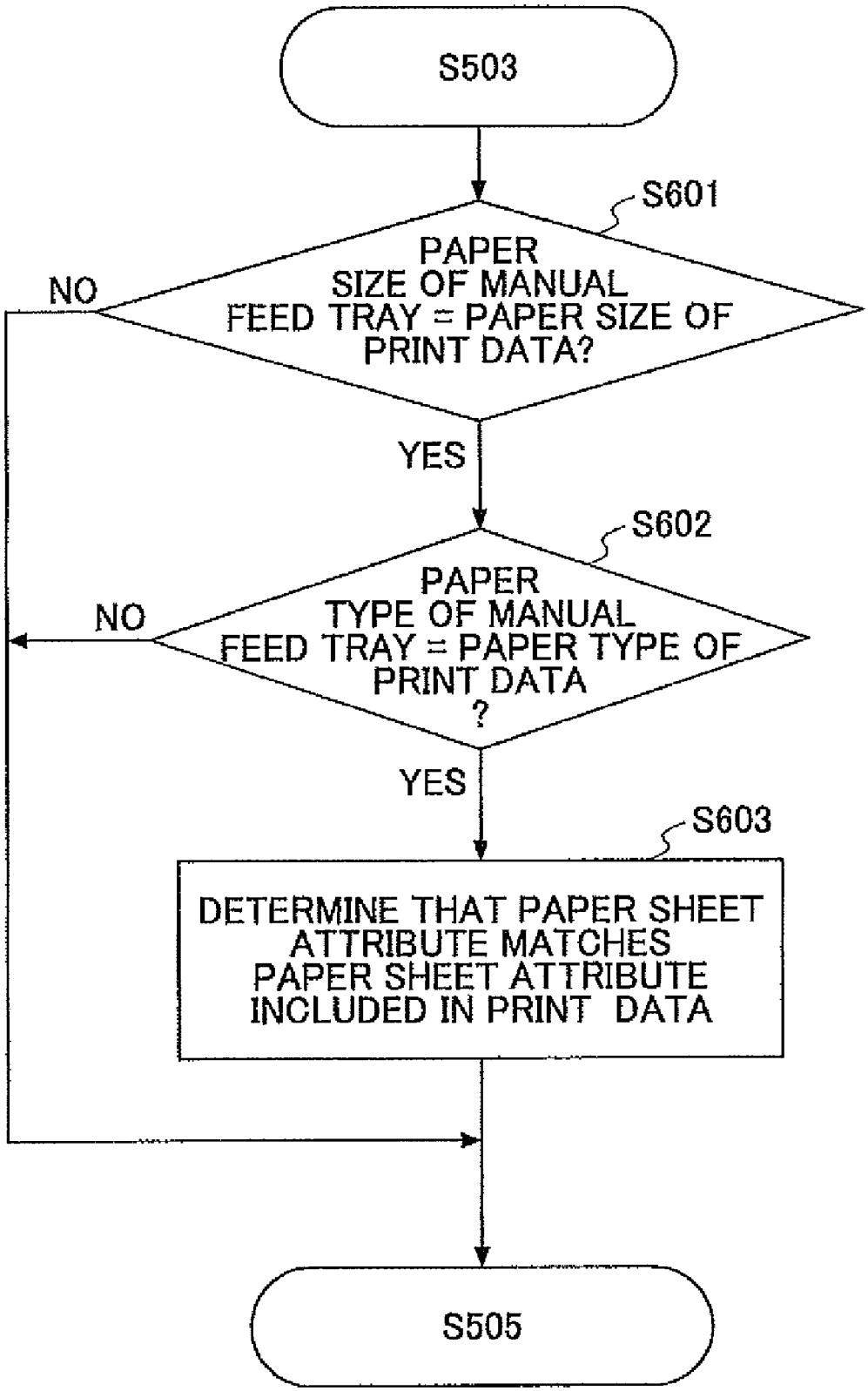
FIG. 12 is a flowchart showing the detail of a process that uses information specified for a paper sheet to be fed from a manual feed tray.

FIG. 12 is a drawing showing the details of the process performed in step S504 of FIG. 11. In step S601 of FIG. 12, a check is made as to whether paper size information among the paper sheet attribute information specified for the manual feed tray as managed by the attribute management unit 130 matches the paper size contained in the print data. If they match, the procedure goes to step S602. Otherwise, the procedure goes to step S505.

In step S602 following step S601, a check is made as to whether paper type information among the paper sheet attribute information specified for the manual feed tray as managed by the attribute management unit 130 matches the paper type contained in the print data. If they match, the procedure goes to step S603. Otherwise, the procedure goes to step S505.

In step S603 following step S602, it is determined that the paper sheet attribute information managed by the attribute management unit 130 matches, without inconsistency, the paper sheet attribute information contained in the print data. When the procedure proceeds to step S505 from step S601 or from step S602, it is determined that the paper sheet attribute information managed by the attribute management unit 130 is inconsistent with, and does not match, the paper sheet attribute information contained in the print data.

FIG. 13 is a drawing showing how the attribute information about a paper sheet to be fed from a manual feed tray is managed. In the table shown in FIG. 13, attributes of paper sheets to be fed from the paper feed trays TRAY1 through TRAY7 and the manual feed tray are associated with the respective trays.

In FIG. 13, the item designated by reference symbol "c" shows attribute information about a paper sheet to be fed from the manual feed tray. In FIG. 13, the size of a paper sheet to be fed from the manual feed tray is specified as A6, the travel direction specified as a longitudinal direction, and the paper type specified as "plain". Such attribute information cannot be acquired from the guide of the manual feed tray. For example, a user may enter attribute information through an operation panel or the like for management by the attribute management unit 130.

<Example of Displaying Screen for Confirming Paper Feeding from Manual Feed Tray>

Figure 14:
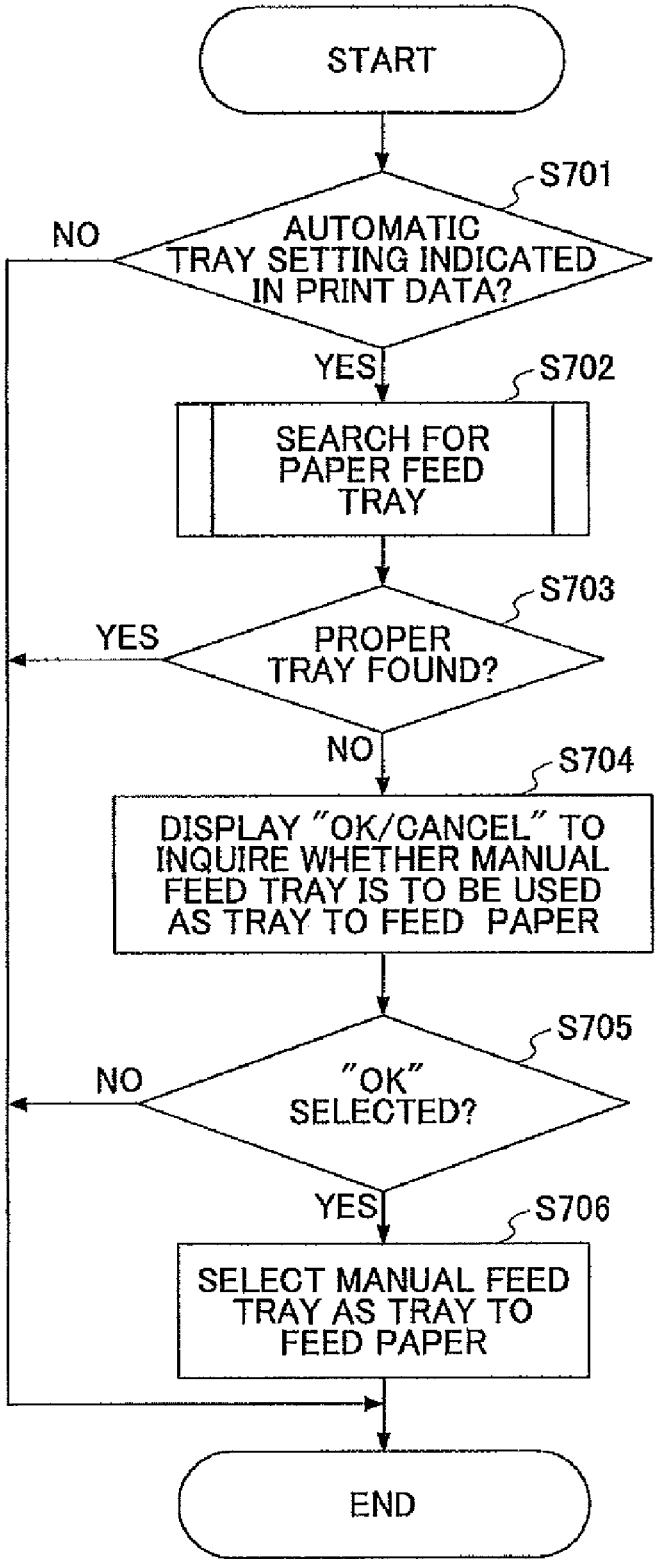
FIG. 14 is a flowchart showing an example of displaying a screen for confirming paper feeding from a manual feed tray.

FIG. 14 is a drawing showing an example of displaying a screen for confirming paper feeding from a manual feed tray. Steps S701 to S703 shown in FIG. 14 are the same as steps S101 through S103 shown in FIG. 3, and a description thereof will be omitted.

In step S704 following step S703, the display screen generating unit 170 generates a confirmation display screen that prompts a user to enter an instruction regarding whether the manual feed tray is to be used as the tray to feed a paper sheet. The generated confirmation display is displayed on the display device of the image forming apparatus 1, the display device of the host computer 3, or the display device controlled by a computer that has transmitted a print request to the image forming apparatus 1.

The procedure then proceeds from step S704 to step S705. If a user enters an instruction indicating the use of the manual feed tray in step S705 on the confirmation display screen displayed in step S704, the procedure proceeds to step S706. If such instruction is not entered, the procedure of selecting a paper feed tray comes to an end. In step S706 following step S705, the manual feed tray is selected as a paper feed tray to feed a paper sheet.

<Detail of Process of Selecting Manual Feed Tray After Passage of Predetermined Time>

Figure 15:
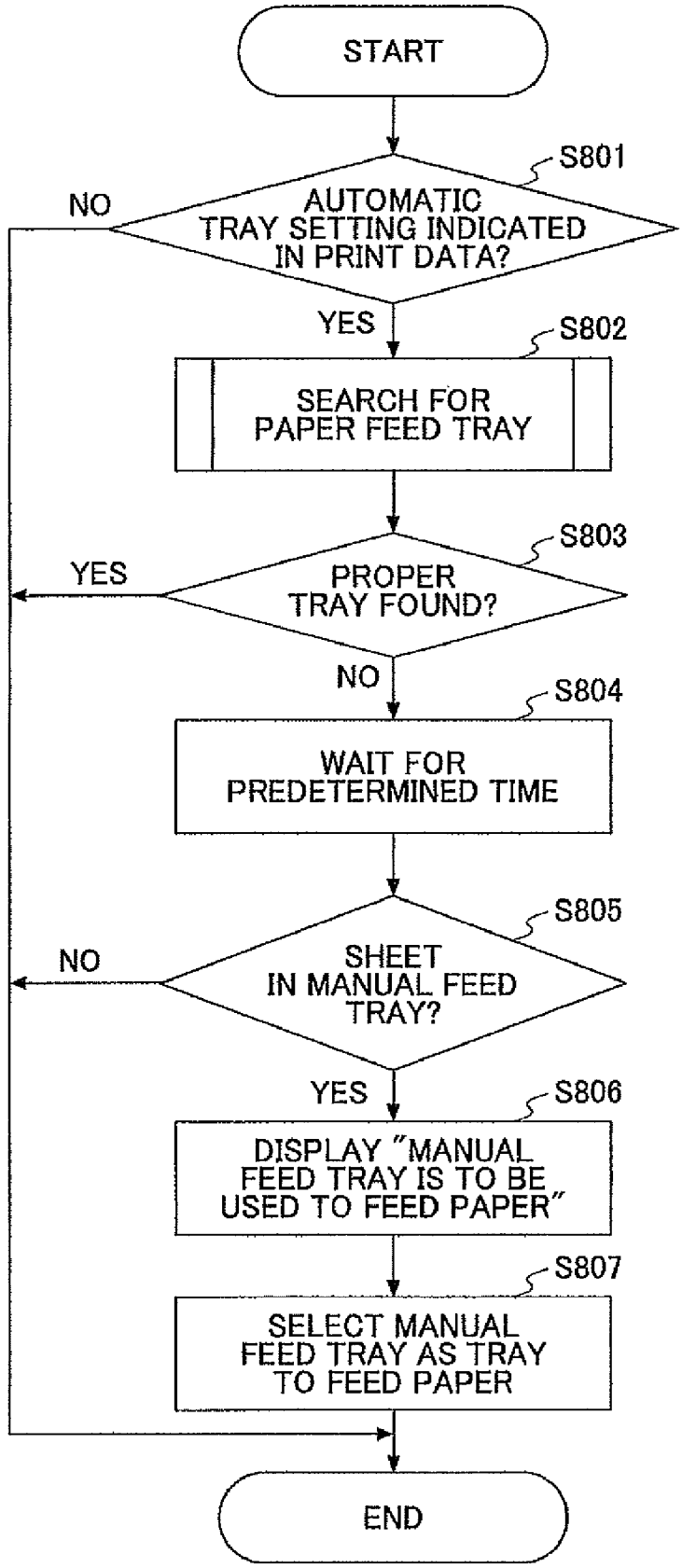
FIG. 15 is a flowchart showing the detail of a process of selecting a manual feed tray after passage of a predetermined time length.

FIG. 15 is a drawing showing a process performed to select a manual feed tray upon passage of a predetermined time length when none of the paper feed trays subjected to automatic tray selection supplies a paper sheet matching the attributes included in the print data.

Steps S801 to S803 shown in FIG. 15 are the same as steps S801 through S803 shown in FIG. 3, and a description thereof will be omitted. In step S804 of FIG. 15, the print process is suspended until a predetermined time length passes. In step S805 following step S804, the attribute detection unit 115 checks whether there is a print sheet placed on the manual feed tray. In step S806 following step S805, a notification screen generated by the display screen generating unit 170 is displayed. In step S807 following step S806, the manual feed tray is selected as a tray to feed a paper sheet.

As described above, the print process is suspended for the predetermined time length in step S804 of FIG. 15, during which the use may load paper sheets into a paper feed tray subjected to automatic tray selection. Alternatively, the display screen generating unit 170 may generate and display a screen prompting a user to load paper sheet in step S804.

<Example of Canceling Finishing Process>

Figure 16:
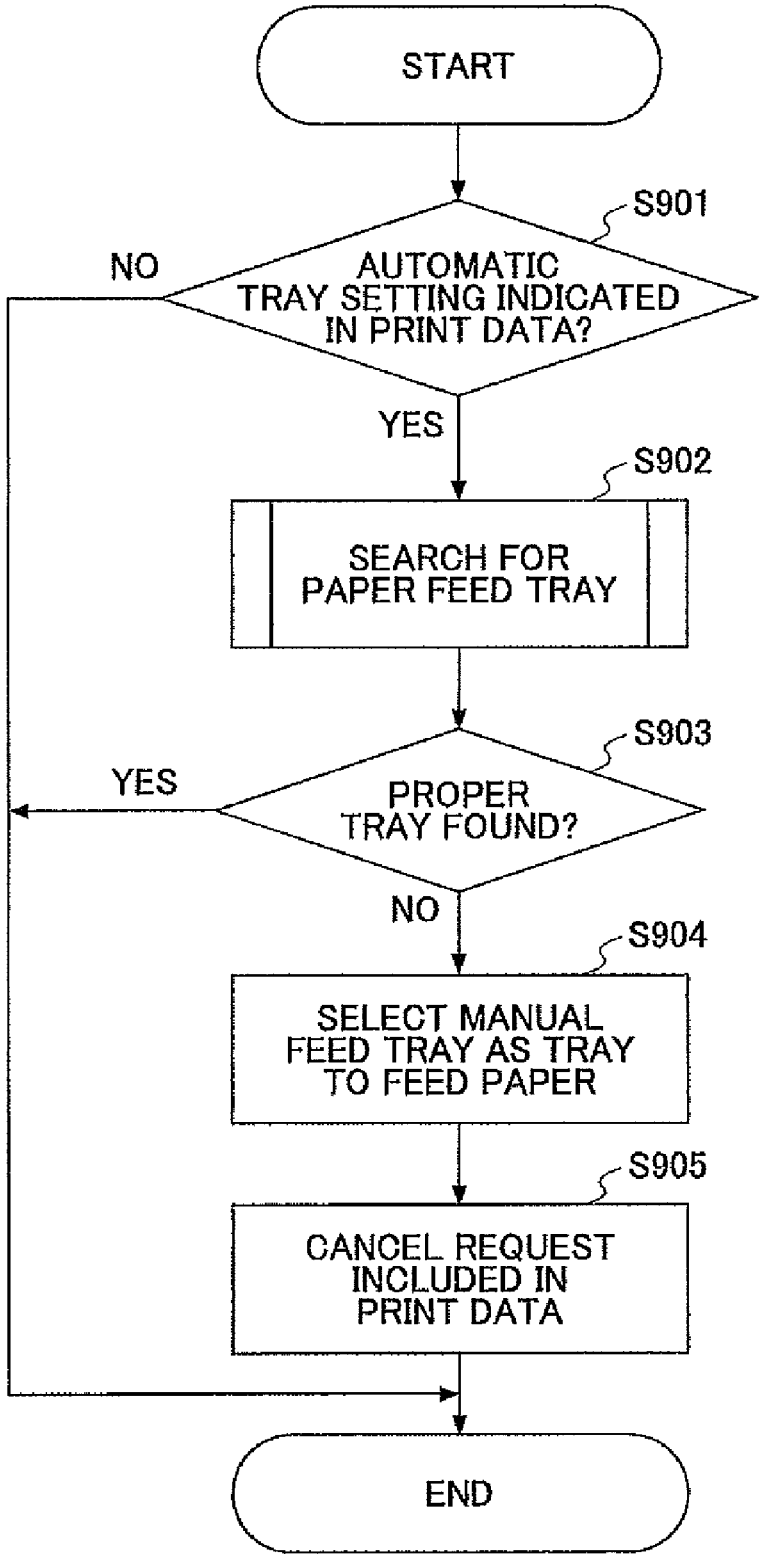
FIG. 16 is a flowchart showing an example of canceling a finishing process.

FIG. 16 is a drawing showing an example of canceling a finishing process with respect to a paper sheet fed from a manual feed tray when a request to perform the finishing process is contained in print data. Steps S901 to S904 shown in FIG. 16 are the same as steps S101 through S104 shown in FIG. 3, and a description thereof will be omitted.

In step S905 following step S904 of FIG. 16, the process control unit 160 sends an instruction indicating the cancellation of a finishing process to the image forming unit 150 based on the fact that a paper sheet is fed from the manual feed tray. In response to this instruction, the image forming unit 150 refrains from performing a finishing process even when the print data contains a request to perform the finishing process.

A finishing process may include a process of making punch holes through paper sheets, a process of stapling paper sheets, a process of attaching a ring binder to paper sheets, a process of binding paper sheets, etc. Further, provision may be made such that duplex printing is cancelled even when a request to perform duplex printing is contained in print data.

With this arrangement, a process such as a finishing process and or duplex printing can be cancelled that may cause apparatus failure when a paper sheet fed from a manual feed tray is a special-type paper sheet. Specifically, an A4-size paper sheet may be fed when the paper width for the manual feed tray is detected as 297 mm and when the print data indicates A3 paper sheet size and stapling or punching. In such a case, stapling or punching may be performed with respect to a portion of the A3-size paper sheet that is outside the area of an A4 size paper sheet, which tends to cause a mechanical failure in the apparatus. The control that cancels a finishing process can prevent such a mechanical failure.

<Configuration of Computer>

Figure 17:
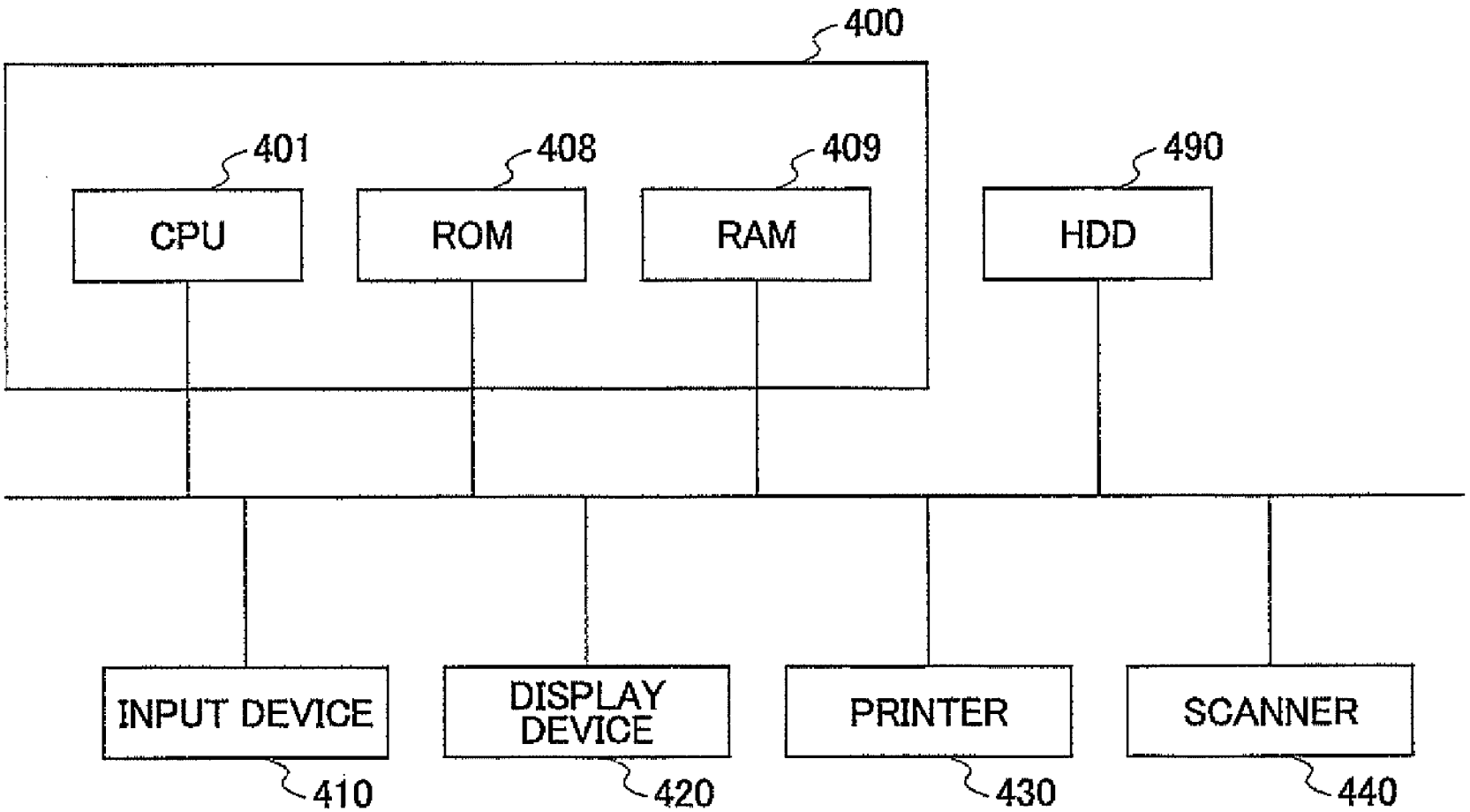
FIG. 17 is a drawing showing the configuration of a computer implementing the image forming apparatus according to the present embodiment.

FIG. 17 is a drawing showing the configuration of a computer implementing the image forming apparatus according to the present embodiment. The computer of FIG. 17 includes a main processing unit 400, an input device 410, a display device 420, a printer 430, a scanner 440, and an HDD 490. The main processing unit 400 is a central portion for providing computing functions, and includes a CPU 401, a ROM 408, and a RAM 409. The CPU 401 executes computer programs of the present embodiment by reading the computer programs from the ROM 408 or the like to load the programs into the RAM 409. The ROM 408 is a nonvolatile memory, and stores computer programs performed by the CPU 401 and parameters and the like necessary to control the image forming apparatus. The RAM 409 serves as a work memory for use by the CPU 401.

The input device 410 may be a keyboard or the like, and is used by a user to enter instructions. The display device 420 serves to display data indicative of status of the computer or the like. The printer 430 is an apparatus that forms an image on a medium. The scanner 440 is an apparatus that optically scans an image formed on a medium. The HDD 490 serves to store a large volume of data such as image data.

The computer programs of the present embodiment may be stored in the HDD 490 or the ROM 408, or may be stored in a recording medium that is mountable to a driver device that is not shown.

The descriptions of exemplary embodiments for implementing the invention have been provided heretofore. The present invention is not limited to these embodiments, but various variations and modifications may be made without departing from the scope of the present invention.

The present application is based on Japanese priority applications No. 2008-017961 filed on Jan. 29, 2008 and No. 2008-307737 filed on Dec. 2, 2008, with the Japanese Patent Office, the entire contents of which are hereby incorporated by reference.

What is claimed is:

1. An image forming apparatus, comprising:

an image forming unit configured to form an image on a medium in response to an image forming request;

a plurality of first medium feed units configured to feed a medium corresponding to the image forming request to the image forming unit;

a second medium feed unit configured to feed a medium to the image forming unit;

an attribute management unit configured to manage first attribute information indicative of media fed by the first medium feed units and second attribute information indicative of a medium fed by the second medium feed unit, the second attribute information being smaller in amount than the first attribute information; and a feed control unit configured to select one of the first medium feed units that feeds a medium corresponding to the first attribute information that matches medium attribute information included in the image forming request, and to select the second medium feed unit upon finding matching between the second attribute information indicative of a medium fed by the second medium feed unit and the medium attribute information included in the image forming request if none of the first medium feed units feeds a medium corresponding to the first attribute information that matches the medium attribute information included in the image forming request, wherein a situation in which none of the first medium feed units feeds a medium corresponding to the first attribute information that matches the medium attribute information included in the image forming request includes a situation in which any of the first attribute information indicative of the media fed by the first medium feed units does not match the medium attribute information included in the image forming request, and a situation in which the one of the first medium feed units that feeds a medium corresponding to the first attribute information that matches the medium attribute information included in the image forming request is empty, and wherein the first attribute information managed by the attribute management unit includes information about sizes of the media fed by the first medium feed units, and the second attribute information managed by the attribute management unit includes information about a length of one side of the medium fed by the second medium feed unit.

2. The image forming apparatus as claimed in claim 1, further comprising a process control unit configured to control whether a process including at least one of a finishing process and duplex printing is performed on a medium on which the image is formed in response to the image forming request, and to cancel the process including at least one of a finishing process and duplex printing when the medium is fed from the second medium feed unit under a condition that the image forming request includes a request to perform the process including at least one of a finishing process and duplex printing.

3. The image forming apparatus as claimed in claim 1, wherein the first attribute information indicative of the media fed by the first medium feed units as managed by the attribute management unit includes at least one of a medium size, a medium type, and a medium thickness.

4. An image forming apparatus, comprising:

an image forming unit configured to form an image on a medium in response to an image forming request;

a plurality of first medium feed units configured to feed a medium corresponding to the image forming request to the image forming unit;

a second medium feed unit configured to feed a medium to the image forming unit;

an attribute management unit configured to manage first attribute information indicative of media fed by the first medium feed units and second attribute information indicative of a medium fed by the second medium feed unit, the second attribute information being smaller in amount than the first attribute information;

a feed control unit configured to select one of the first medium feed units that feeds a medium corresponding to the first attribute information that matches medium attribute information included in the image forming request, and to select the second medium feed unit upon finding matching between the second attribute information indicative of a medium fed by the second medium feed unit and the medium attribute information included in the image forming request if none of the first medium feed units feeds a medium corresponding to the first attribute information that matches the medium attribute information included in the image forming request;

a display screen generating unit configured to generate a notification screen for indicating medium feeding from the second medium feed unit, wherein the second medium feed unit feeds a medium upon passage of a predetermined time period following a detection that any of the first attribute information indicative of the media fed by the first medium feed units does not match the medium attribute information included in the image forming request; and a time input unit configured to enter data indicative of the predetermined time period.

5. A method of controlling medium feeding in an image forming apparatus, comprising:

an image forming step of forming an image on a medium in response to an image forming request; and a feed control step of selecting one of a plurality of first medium feed units that feeds a medium corresponding to attribute information that matches medium attribute information included in the image forming request, and of selecting a second medium feed unit upon finding matching between attribute information indicative of a medium fed by the second medium feed unit and the medium attribute information included in the image forming request if none of the first medium feed units feeds a medium corresponding to the attribute information that matches the medium attribute information included in the image forming request, wherein the feed control step is configured to check information about sizes of the media fed by the first medium feed units and information about a length of one side of the medium fed by the second medium feed unit.

6. The method as claimed in claim 5, further comprising a process control step of controlling whether a process including at least one of a finishing process and duplex printing is performed on a medium on which the image is formed in response to the image forming request, and of canceling the process including at least one of a finishing process and duplex printing when the medium is fed from the second medium feed unit under a condition that the image forming request includes a request to perform the process including at least one of a finishing process and duplex printing.

* * * * *